United States Patent [19]

de la Fuente et al.

[11] 4,454,633

[45] Jun. 19, 1984

[54] APPARATUS FOR RELEASING PRE-STRESS CABLE GRIPPING MEANS WHEN SAID CABLE IS BEING DETENSIONED

[75] Inventors: Carlos de la Fuente, Nanterre; Bernard Amelot, Epernon, both of France

[73] Assignee: Freyssinet International (STUP), Boulogne-Billancourt, France

[21] Appl. No.: 385,680

[22] Filed: Jun. 7, 1982

[51] Int. Cl.[3] ..... F16G 11/00; E04C 3/26

[52] U.S. Cl. ..... 24/115 R; 24/122.6; 52/223 L; 254/228

[58] Field of Search ..... 254/228, 264; 24/115 R, 24/122.6, 136 B, 263 R; 52/223 L

[56] References Cited

U.S. PATENT DOCUMENTS

| | | | |
|---|---|---|---|
| 3,412,511 | 11/1968 | Dietrich | 52/223 L |
| 3,605,361 | 9/1971 | Howlett et al. | 24/122.6 X |
| 4,114,242 | 9/1978 | Luthi | 24/115 R |

*Primary Examiner*—Stuart S. Levy
*Assistant Examiner*—Joseph J. Hail, III
*Attorney, Agent, or Firm*—Ned L. Conley; David Alan Rose; William E. Shull

[57] ABSTRACT

Apparatus for releasing the means for gripping a prestress cable, to allow the cable to be detensioned. Each strand is usually maintained in the tensioned state by a cone truncated group of gripping means enveloping this strand. According to the invention each of the gripping means of a group surrounding a strand comprises towards the outside an extension which, in the active state of the gripping means, is spaced apart from this strand, all the extensions thus determining a volume of revolution terminating towards the outside by a hooking flange, while the extractor is formed by resilient parts distributed along the generatrices of a cylinder and comprises inwardly turned hooking flanges, the circumference determined by all the inner edges of the projections in the state of rest being of smaller diameter than that of the volume formed by the outer surface of the extensions of the gripping means beyond their hooking flange, when these gripping means are in the active state.

3 Claims, 9 Drawing Figures

APPARATUS FOR RELEASING PRE-STRESS CABLE GRIPPING MEANS WHEN SAID CABLE IS BEING DETENSIONED

The present invention relates to an apparatus for releasing the means for gripping a pre-stress cable, to allow the cable to be detensioned.

It is known that, for multi-strand pre-stress cables, each strand, i.e. a wire or a strand, is usually maintained in the tensioned state by a cone truncated group of gripping means enveloping this strand, which group is engaged, with the strand which it grips, in a conical opening in an anchor block.

When all the strands are tensioned to the desired value, this group of gripping means is forced around each strand in said opening. In this way, when the tensioning apparatus is released, by truncation of the tensioned cable, the group of gripping means is engaged further in said opening so that the strand is very efficiently gripped and, in particular, it causes the roughness provided on the inner faces of the gripping means to penetrate superficially in the surface of the strand, to increase efficiency thereof.

In certain applications of pre-stress, it is necessary to be able to detension the cables to replace them or simply check their state of conservation.

After having released the groups of gripping means out of their openings, by an overtension imposed on the cable, it is therefore expedient to retain each group in order, when the tension is released to detension the cable, to prevent these groups of gripping means from returning into the conical openings and, gripping the strand, preventing detension.

For this purpose it has been proposed in U.S. Pat. No. 4,114,242 (LUTHI-LOSINGER), to arrange in that part of the gripping means which projects beyond the anchor block, an inner groove in which engage the outwardly projecting flanges of the resilient parts of a gripping device surrounding the strand, which will be referred to hereinafter as an "extractor", surrounding the strand. The extractor, obtained from a sort of steel tube, has radial slots cut out therefrom to form these resilient parts.

Such an embodiment presents obvious drawbacks: In order to be able to be engaged in the space between the strand and the entrance of the groove, the projecting flanges and the resilient parts which bear them must be thin, therefore fragile and easily deformable. To position an extractor, all the resilient parts must be tightened at once, this leading, for cables comprising numerous closely located strands, in order to tighten simultaneously all the resilient parts of all the extractors, to using a mobile plate with multiple holes through which these extractors pass. In this way, no individual control of the correct positioning of the extractors is possible. Moreover, this modus operandi can be applied only to groups of gripping means whose axes are parallel. Finally, such extractors maintain the gripping means in contact with the strand with the result that, when tension is released, these gripping means are urged towards each corresponding strand, so that, during the retaining action of the extractors, the inner rough surface of the gripping means must rub against the strand, which provokes a reciprocal deterioration of the gripping means and of the strand.

It is an object of the invention to reduce or even eliminate this effect of reciprocal deterioration when the cable is detensioned.

It is a further object of the invention to provide an apparatus in which each of the gripping means retaining devices is rapidly placed in position, individually by hand, this making it possible to check visually that each of them is correctly fastened.

It is another object of the invention to allow the gripping means to be retained during detensioning, even if the axes of the groups of gripping means are not parallel to one another, which is the case when, in the anchor block, the outer cable strands are distributed to form a conical surface.

Yet another object of the invention is to make it possible, in the event of breakdown of certain of the retaining devices leaving the corresponding strands of cable tensioned to restart the detensioning manoeuvre, by replacing the defective retaining devices by a simple, rapid manoeuvre, whilst those which have fulfilled their function are dismantled.

According to the main feature of the invention, each of the gripping means of a group surrounding a strand comprises towards the outside an extension which, in the active state of the gripping means, is spaced apart from this strand, all the extensions thus determining a volume of revolution terminating towards the outside by a hooking flange, whilst the extractor is formed by resilient parts distributed along the generatrices of a cylinder and comprises inwardly turned hooking flanges, the circumference determined by all the inner edges of the projections in the state of rest being of smaller diameter than that of the volume formed by the outer surface of the extensions of the gripping means beyond their hooking flange, when these gripping means are in the active state.

The invention will be more readily understood on reading the following description with reference to the accompanying drawings, in which.

Figure 5:
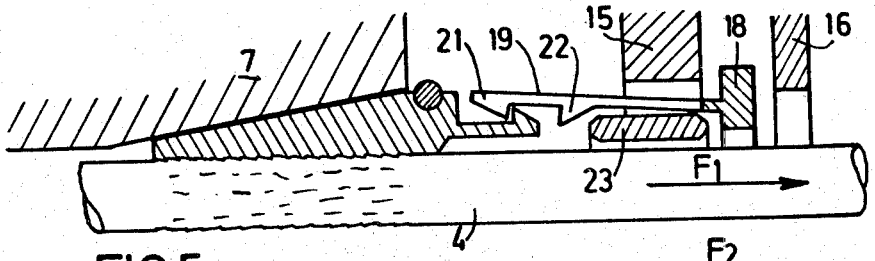
Figure 6:
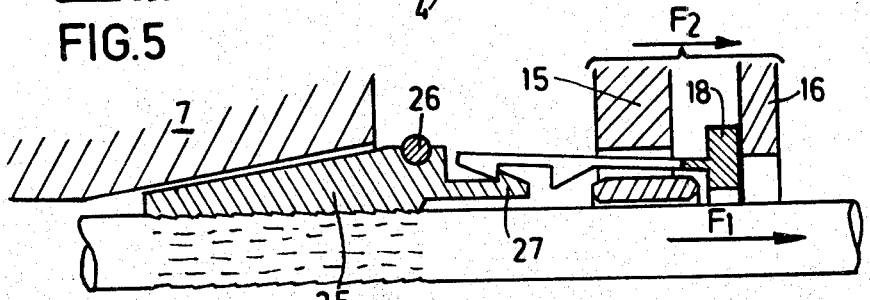
Figure 7:
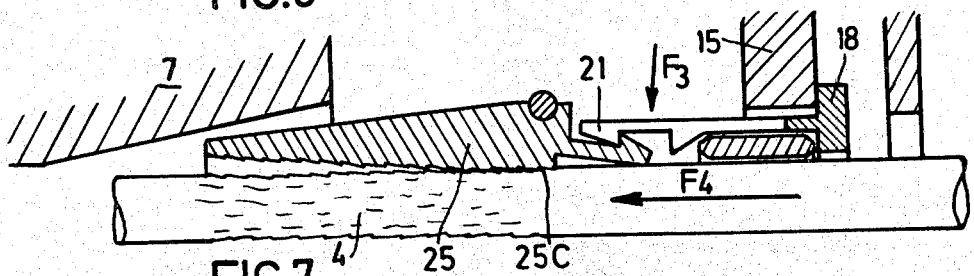

FIGS. 5, 6 and 7 schematically show the successive steps of retaining a group of gripping means by the device according to the invention.

Figure 8:
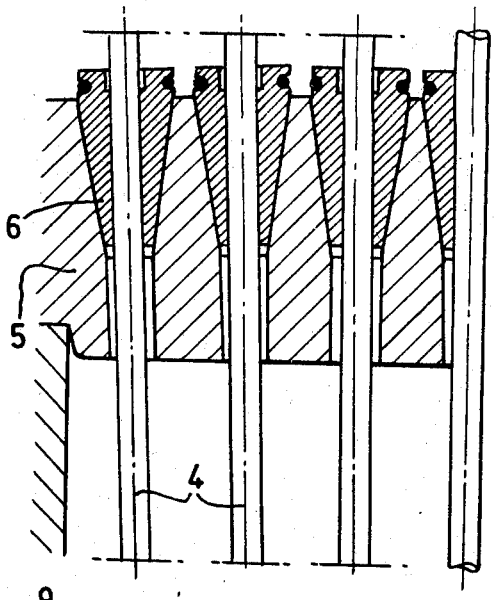
Figure 8:
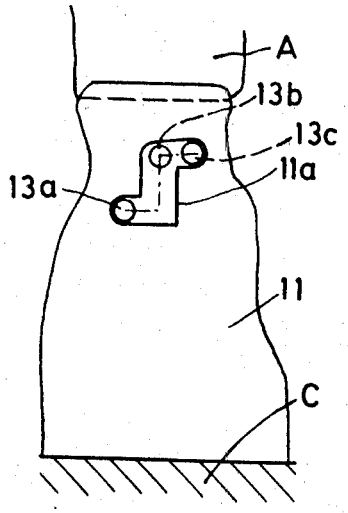
Figure 2:
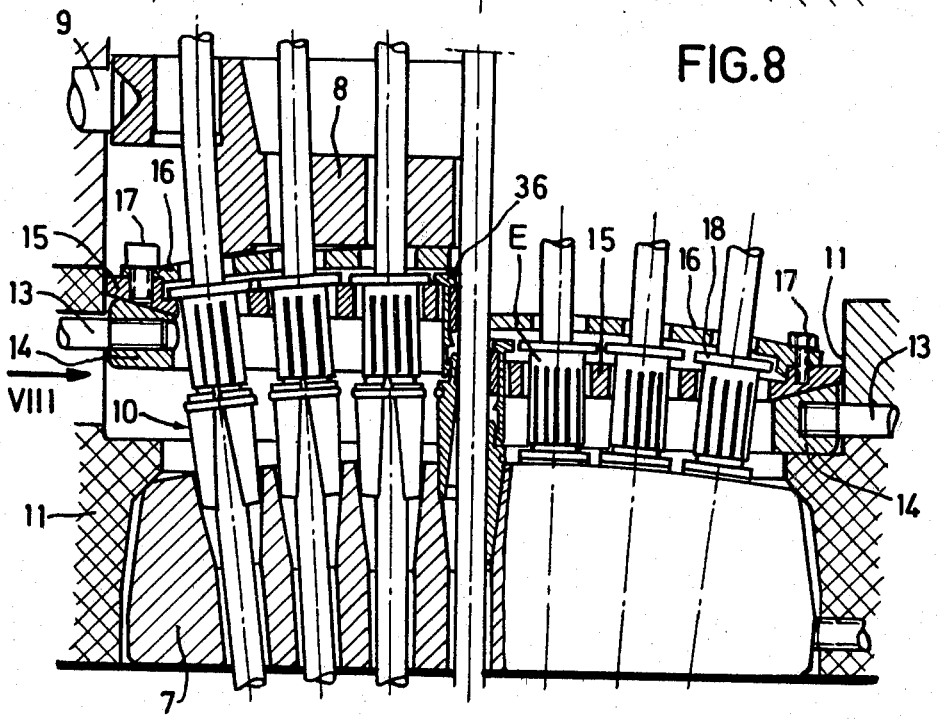
FIG. 2 is an enlarged view similar to FIG. 1 showing, on the right-hand side, the extractors in place on the blocked gripping means and, on the left-hand side, the gripping means disengaged and maintained by the extractors.
Figure 3:
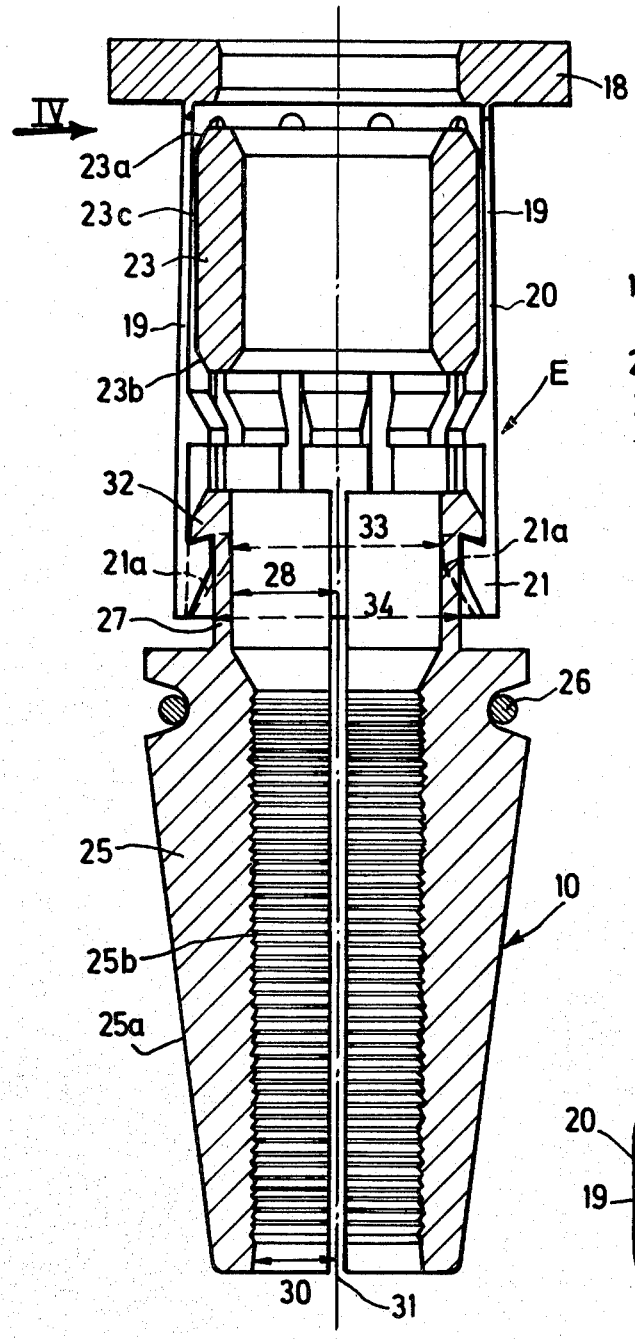
FIG. 3 is an enlarged view of an extractor engagably positioned over the outer flange of the gripping means.

FIG. 8 is a view along VIII of FIG. 2.

Figure 9:
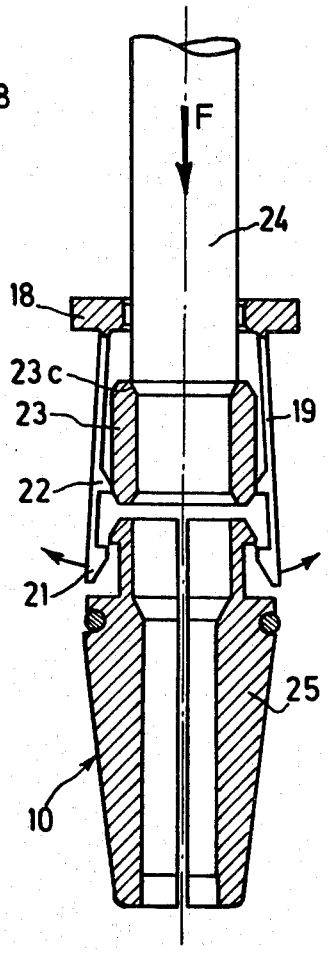
Figure 4:
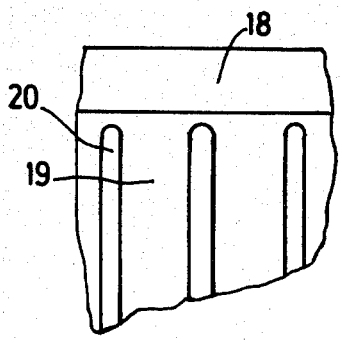
FIG. 4 is a view along IV of FIG. 3.

FIG. 9 is a view of a ring engagably positioned in an extractor to force in spaced apart relation its resilient parts.

Figure 1:
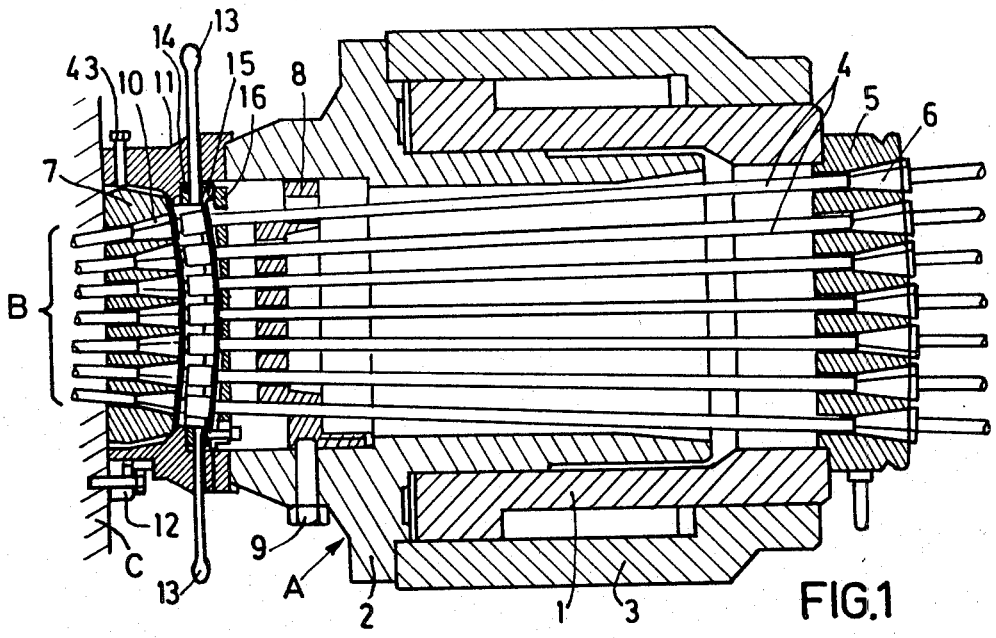
FIG. 1 is a partially schematic axial section through an anchor block of a cable comprising a plurality of strands and a tensioning jack, said assembly being completed by a device for maintaining the groups of gripping means allowing the cable to be detensioned.

Referring now to the drawings, the jack A shown in FIG. 1 is a double effect jack, with annular piston 1 mobile in a cylinder body formed by two cylindrical parts 2 and 3 assembled together.

For tensioning or detensioning the strands 4 of a cable B, the piston 1 is capped by a head 5, through which the strands of the cable pass, in which head said strands are each individually anchored by a group of three temporary gripping means 6.

Active anchoring of the cable B is ensured in an anchor block 7 supported against the pre-stress structure C.

For guiding and distributing the strands of cable inside the axial channel of the jack, the latter is equipped with a perforated plate 8, immobilised by bolts 9.

For purpose of detensioning, the jack A is supported against the pre-stress structure C via a detensioning ring 11 in which this jack fits and which, as a safety measure, is fixed to this structure by lugs 12 and, moreover, is centred by bolts 43 with respect to the anchor block.

The ring 11 comprises on its periphery (cf. FIG. 8), at least two diametrically opposite Z-shaped openings 11*a* (and preferably four openings of this type at right angles), which have radial handles 13 passing therethrough. These handles 13 are screwed in a rotating ring 14 (cf. FIG. 2) which occupies a low position when (FIG. 8) the handles 13 are in position 13*a* but may be raised vertically (handles at 13*b*) then locked in high position (handles at 13*c*).

Two plates 15 and 16 are rest on the ring 14, said plates being assembled by bolts 17 and being perforated with holes in register corresponding to the position of the strands. Between the two plates are disposed, with clearance, the flanges 18 of extractors E shown in detail (with the associated groups of gripping means in FIGS. 3 to 7 and 9).

Each extractor, obtained by lathe-machining from a tubular metal body, comprises a certain number of resilient parts 19 (ten in the present case) obtained by milled diametrical slots 20. Before the slots are made, two collars have been machined inside the extractor, one towards the free end of the resilient parts, the other towards the centre thereof, so that each resilient part 19 comprises at the end a flange 21 and, towards the centre, a boss 22. To force the resilient parts into spaced apart relationship, a ring 23 is introduced into the extractor, which ring is machined symmetrically to avoid errors in positioning and which comprises conical surfaces forming ramps: 23*a* for positioning thereof; 23*b* for spacing apart the resilient parts via the bosses 22 (FIG. 9) and 23*c* for receiving and centering the end of a tubular tool 24, which, forced in the direction of arrow F, spaces the resilient parts 19 apart to release the gripping means 25.

The gripping means 25 of the same group (generally three in number), comprise in known manner: an outer surface 25*a* which is truncated when the group is engaged in the anchor block, an inner surface 25*b* which is scored or otherwise rendered rough and an elastic assembly ring 26 which always maintains them substantially at the same level.

In addition, according to the invention, each gripping means comprises an extension 27 which is spaced apart from the surface 25*b* to be located at a distance 28 from the axis of the group greater than the distance 30 between the surface 25*b* and this same axis 31. This extension 27 is terminated by a portion of flange 32 forming an outer flange for said extension.

Finally, when the extractor is in rest position, the flanges 21 thereof are located at 21*a*, i.e. they determine an inner circle of diameter 33 smaller than the outer diameter 34 of the volume formed by the assembly of the extensions 27 when the group 10 of gripping means 25 is in active position.

FIGS. 5 to 7 enable the manoeuvre and operation of the device according to the invention to be more readily understood.

The detensioning ring 11 with the rotating ring 14 and its handles 13 in position 13*a* is firstly positioned and fixed around the anchor block. The different strands are engaged in the holes of the plate 15 which rests on the ring 14.

By fitting them one by one by hand on the different strands, the extractors E are engaged and clipped on the extension 27 of the groups of gripping means in place. The plate 16, fitted on the strands, is then placed on the plate 15 and fixed thereto by the bolts 17.

It will be noted that, the diameter of the holes 36 of the plate 15 being substantially larger than that of the extractors, it is very easy to position and extractors. Moreover, it will be noted, due to the spaced apart relationship of the two plates, that the flanges 18 are free between these plates and, in addition, that the curvature of these plates is such that the strands 4 of cables are perpendicular to their surface. The device according to the invention is therefore extremely versatile; it allows detensioning of cables distributed in conical form.

After the plates 15 and 16, the plate 8 is then placed in turn, then the annular jack A, then the piston head 5 and the temporary gripping means 6 are fixed, whilst the jack A is near its maximum extension, i.e. the piston 1 must be assumed to be displaced virtually completely towards the right in FIG. 1.

The situation is then the one shown in FIG. 5.

A traction is at this stage exerted by the jack A on the cable B in the direction indicated by the arrow $F_1$. Initially (FIG. 6), each group of gripping means 10 is detached from the corresponding truncated opening of the block 7. Due to the penetration of the scores in the surface of the strand, it is possible that the gripping means remain adherent to this strand. However, in this movement, the flange 18 of the extractor encounters the plate 16 and then, by manoeuvring the handles 13, the two plates 15 and 16 are displaced in the direction of arrow $F_2$, thus returning the flange 18 against the plate 15. In this way, the shocks imposed on the flange 18 necessarily detach the gripping means from contact with the strands. The gripping means being free, the elasticity of the resilient parts 19 acting in the direction of arrow $F_3$ (FIG. 7), causes each of them to pivot and to remain in contact with the strand only by its heel 25*c* where the scores may be intentionally less pronounced. Consequently, by progressively displacing the piston 1 of the jack towards the left (FIG. 1), the strand 4 may be detensioned (arrow $F_4$), with a minimum friction in contact with the group of gripping means and consequently a very reduced risk of the group of gripping means returning into the opening in the block 7.

When the cable is detensioned, the assemblies which are each formed by a group of gripping means and by an extractor may be disengaged after removal of the jack and the perforated plates 8 and 16, then the extractors are separated from the gripping means in the manner shown in FIG. 9. Separation of the extractor and the gripping means may also be obtained when the assembly is in place on the strand, for example for replacing a defective extractor.

In this way, a cable detensioning apparatus is obtained, easy to adapt to all high power multi-strand cables, especially those which maintain the concrete safety enclosures of nuclear reactors in a state of prestress.

What is claimed is:

1. In an apparatus for gripping and holding at least one truncated group of gripping means surrounding a strand of a pre-stress cable under tension, and anchoring this strand in a truncated opening in an anchor block, said apparatus being disposed between said block and an annular tensioning jack through which this cable passes in order to detension this tensioned strand, in which apparatus each of the gripping means of the group comprises, towards the outside of the block, an extension which, in the anchored state of the strand, extends outwardly therefrom and is terminated by a hooking flange, said apparatus comprising, for each group of gripping means, an extractor fitted on the strand, which is formed by radially elastic longitudinal resilient parts, substantially parallel to the strand and distributed circumferentially therearound, these resilient parts comprising at their ends inwardly turned hooking projections, the smallest circumference determined by all the inner edges of these projections, in the state of rest of the extractor, being of smaller diameter than that of the volume formed by the outer surface of the extensions of the gripping means near their hooking flange, in the anchored state of the strand, said apparatus further comprising means for displacing and maintaining these extractors in the longitudinal direction of the strand, the extractors comprising a flange on the side opposite of the projections, and the means for displacing and maintaining the extractors comprising an annular block surrounding the anchor block and serving as support for the periphery of the jack, a ring, mobile inside this block in rotation and in translation, means for manuvering this ring, and a plate perforated with holes greater than the diameter of an extractor but smaller than that of the flange traversed by a strand and its extractor, said plate resting on said mobile ring.

2. The apparatus of claim 1, where there is fixed to said perforated plate, at a distance greater than the thickness of said flanges, a second plate perforated with holes corresponding to those of the first plate and of smaller diameter than that of an extractor flange.

3. The apparatus of claim 1, associated with a cable whose strands are, for anchoring, distributed to form a conical surface, wherein the surface of the perforated plate has a curved enveloping form so as to be perpendicular to each of the strands where they leave the anchor block.

* * * * *